US007359662B2

(12) United States Patent
Yamada et al.

(10) Patent No.: US 7,359,662 B2
(45) Date of Patent: Apr. 15, 2008

(54) IMAGE FORMING APPARATUS WITH CONTROL BLADE HAVING AN ARCUATE SHAPE

(75) Inventors: Yoichi Yamada, Nagano (JP); Katsumi Okamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 99 days.

(21) Appl. No.: 11/287,153

(22) Filed: Nov. 23, 2005

(65) Prior Publication Data

US 2006/0140682 A1 Jun. 29, 2006

(30) Foreign Application Priority Data

Nov. 26, 2004 (JP) ..... P2004-341589
Nov. 26, 2004 (JP) ..... P2004-341590

(51) Int. Cl.
*G03G 15/08* (2006.01)

(52) U.S. Cl. ..... 399/284

(58) Field of Classification Search ..... 399/55, 399/274, 284
See application file for complete search history.

(56) References Cited

U.S. PATENT DOCUMENTS 4,796,561 A * 1/1989 Takano et al. ..... 399/274
5,895,151 A * 4/1999 Kinoshita et al. ..... 399/284
6,473,572 B1 * 10/2002 Uchiyama et al. ..... 399/55 X
6,775,506 B2 * 8/2004 Endoh et al. ..... 399/284
2004/0081476 A1 4/2004 Hama

FOREIGN PATENT DOCUMENTS

| | | |
|---|---|---|
| JP | 57-078574 | 5/1982 |
| JP | 06-110311 | 4/1994 |
| JP | 11-174828 | 7/1999 |
| JP | 2004-077873 | 3/2004 |

* cited by examiner

*Primary Examiner*—Sandra L. Brase
(74) *Attorney, Agent, or Firm*—Hogan & Hartson LLP

(57) ABSTRACT

An electrostatic latent image is formed on an image carrier. A developer includes a container containing toner, a first roller facing the image carrier and rotated to cause the toner to adhere onto the image carrier to develop the electrostatic latent image as a toner image, a second roller supplying the toner from the container to the first roller, and a control member extending in an axial direction of the first roller and brought into contact with the first roller. A tip end edge of the control member is situated in an upstream side of a contact line that extends in the axial direction so as to include at least one contact point between the control member and the first roller, relative to a rotating direction of the first roller. A distance between the tip end edge and the contact line is not constant relative to the axial direction.

7 Claims, 8 Drawing Sheets

IMAGE FORMING APPARATUS WITH CONTROL BLADE HAVING AN ARCUATE SHAPE

BACKGROUND OF THE INVENTION

The present invention relates to an image forming apparatus, and more particularly, to an image forming apparatus capable of forming a high-quality image by means of causing toner to adhere onto an image forming face at uniform density through transfer.

An image forming apparatus of electrophotographic recording type which forms an electrostatic latent image on the surface of an image carrier formed from a photosensitive member by means of exposure has hitherto been known. In this image forming apparatus, the electrostatic latent image is developed with toner, and a resultant toner image is carried by the surface of an image carrier. The toner image is then transferred to a recording medium, such as a recording sheet, to thus form an image. The electrostatic latent image is subjected to toner development by means of rotating a development roller opposing the surface of the image carrier, to thus cause the toner to transfer and adhere to an outer peripheral surface of the development roller so as to develop the electrostatic latent image with the toner. A supply roller is rotated in a toner housing space in a manner that the supply roller is compressed to the development roller so that the toner is supplied to the development roller.

In an image forming apparatus adopting this electrophotographic recording type, an image is formed by transferring a toner image, which has been formed by developing an electronic latent image on the surface of a image carrier, in its present form on a recording medium, and fusing the thus-transferred toner image. The thickness of the toner laid over the outer peripheral surface of the development roller, which is used for developing the electrostatic latent image on the surface of the image carrier, greatly affects the density of the image on the recording medium. For this reason, this image forming apparatus is provided with a control member for rendering the thickness of the toner that is applied to and caused to adhere to the outer peripheral surface of the development roller uniform. This control member is disposed in parallel to the outer peripheral surface of the development roller, and controls the thickness of the toner so as to become uniform by means of scraping the toner.

Here, opposite ends of the development roller are rotatably supported. Accordingly, when the development roller is pressed by the member (e.g. the supply roller) parallel to the axial direction, a center portion thereof becomes bowed so as to escape. The center portion also becomes deflected and bowed with respect to the control member that should be disposed in parallel to the outer peripheral surface of the development roller. As a result of a recent improvement in metallic material, the metallic material is changed from, e.g., a steel material to aluminum, for making the development roller lightweight. Further, the structure of the development roller is changed from a cylindrical (solid) highly-rigid structure to a cylindrical (hollow) low-rigidity structure. In association with these changes, the tendency of deflection becomes greater.

The deflection of this development roller makes it difficult for the control member to render the thickness of the toner adhering to the outer peripheral of the development roller uniform. As a result, difficulty is encountered in rendering the density of the toner image formed by developing the electrostatic latent image on the surface of the image carrier uniform. Consequently, when that toner image is transferred and fused, in its present form, onto the recording medium, the non-uniform thickness of the toner on the outer peripheral surface of the development roller deteriorates the quality of an image formed on the recording medium.

Therefore, the following has been proposed with respect to the image forming apparatus adopting an electrophotographic recording type. Namely, the control member is formed into an outwardly-bowed shape so as to follow the curve of the outer peripheral surface of the development roller, or the center portion of the control member is pressed to bend the control member toward the development roller, thereby making the thickness of the toner on the outer peripheral surface of the development roller uniform (see, e.g., JP-A-6-110311).

In such an image forming apparatus, so-called patch processing is performed for checking whether or not a bias voltage used for causing the toner to transfer from the development roller to the surface of the image carrier has been adjusted so as to be able to form image from a fine-line image to a solid image with high quality. By means of the patch processing, a patch image is formed as a dummy image, and the density of the toner of the patch image is detected by a patch sensor, whereby the bias voltage is ascertained and adjusted (see, e.g., JP-A-2004-77873).

However, this related image forming apparatus (e.g., JP-A-6-110311) has such a structure that a flat portion of the control member, which is located closer to a rearward end than a leading-side edge, is brought into compressed contact with the outer peripheral surface of the development roller, thereby scraping the toner adhering to the outer peripheral surface by use of the leading-side edge to thus control the thickness of the toner to a fixed value. When the leading-side edge of the control member protrudes so as to depart, in a tangential direction of the developing roller, from the location where the control member is brought into compressed contact with the outer peripheral surface of the development roller, the layer of the toner that enters a space between the outer peripheral surface of the development roller and the leading-side edge becomes thicker.

Here, the development roller becomes deflected as a result of being brought into compressed contact with the supply roller. In contrast, the control member is brought into compressed contact with the outer peripheral surface of the development roller at a position deviating from the compressed contact position. It is difficult to align the control member with the curve of the outer peripheral surface of the development roller with high accuracy. For these reasons, as in the case of the image forming apparatus described in JP-A-6-110311, even when the control member is bent, the center portion of the bent control member approaches the outer peripheral surface of the development roller that is bent by being brought in contact with the supply roller, from a direction slightly different from the direction in which the development roller is bent (see FIG. 5A).

Consequently, as compared with opposite ends of the control member, the center portion of the leading-side edge of the control member protrudes so as to separate, in the tangential direction, from the outer peripheral surface of the development roller, thereby becoming displaced in a direction in which the layer of toner becomes thick. Thus, the thickness of the toner on the outer peripheral surface of the development roller cannot effectively be made uniform in the axial direction thereof.

Moreover, when the thickness of the toner on the outer peripheral surface of the development roller is non-uniform with respect to the axial direction and uncontrollable, a correlation between the density of the toner image of the patch image and the density of the toner image formed in another area is uncertain. Therefore, even when the bias voltage is adjusted by reference to the density of the toner image located at the position where the patch image is formed (the position where the patch sensor performs detection), development of the toner image performed during operation cannot be optimized.

SUMMARY

It is therefore an object of the invention to provide an image forming apparatus capable of forming a high-quality image by making the thickness of toner on an outer peripheral surface of a development roller uniform, with a simple structure.

It is also an object of the invention to provide an image forming apparatus capable of forming a high-quality image by arranging a patch sensor at an optimal position.

In order to achieve the object, according to the invention, there is provided an image forming apparatus comprising:

an image carrier on which an electrostatic latent image is formed;

a developer, comprising:

a container, containing toner;

a first roller, facing the image carrier, and rotated to cause the toner to adhere onto the image carrier to develop the electrostatic latent image as a toner image;

a second roller, supplying the toner from the container to the first roller; and a control member, extending in an axial direction of the first roller, and brought into contact with the first roller, wherein a tip end edge of the control member is situated in an upstream side of a contact line that extends in the axial direction so as to include at least one contact point between the control member and the first roller, relative to a rotating direction of the first roller, a distance between the tip end edge and the contact line is not constant relative to the axial direction.

With this configuration, the tip and edge of the control member is formed such that the extent to which the tip end edge projects in a tangential direction of the first roller from the position where the control member is brought into contact with the first roller varies from opposite ends of the tip end edge to a center portion of the same. The thickness of the toner that enters between the first roller and the control member after the toner has been scraped by the tip end edge can be adjusted in relation to the axial direction of the first roller. Consequently, the extent to which the tip end edge of the control member projects is designed (adjusted) in accordance with the degree of deflection of the first roller, whereby the thickness of the toner entering between the first roller and the control member can be made uniform with respect to the axial direction.

A gap defined between the tip end edge and a peripheral surface of the first roller may be made constant in the axial direction.

in this case, the extent to which opposite ends of the tip end edge project and the extent to which the center portion of the tip end edge projects are controlled such that the gap between the tip end edge of the control member and the outer peripheral surface of the first roller has a uniform width with respect to the axial direction. Therefore, the toner having a uniform thickness can be caused to enter the axially-uniform gap defined between the tip end edge and the outer peripheral surface of the first roller while the toner on the outer peripheral surface of the first roller is being scraped by the tip end edge of the control member.

A distance between opposite end portions of the tip end edge in the rotating direction and the contact line may be greater than a distance between a center portion between the opposite end portions and the contact line so that the tip end edge has an arcuate shape.

In this case, the center portion of the tip end edge of the control member recedes from opposite end portions of the same, thereby forming a gap between the outer peripheral surface of the first roller and the control member. Here, the first roller and the control member are set in such a positional relationship that the first roller is bowed in a direction in which the second roller is brought into contact with and then separates from the first roller, and that the control member scrapes the toner on the outer peripheral surface of the first roller, which is rotated so as to head to the control member, by use of the tip end edge. Therefore, provided that the first roller is bowed and that the tip end edge of the control member is straight, the center portion of the tip end edge substantially projects from opposite end portions thereof with reference to the tangential direction of the outer peripheral surface of the bowed first roller. The toner scraped to a thickness greater than that achieved in opposite end portions of the tip end edge enters the center portion of the tip end edge and the outer peripheral surface of the first roller, thereby resulting in a failure to make the thickness of the toner uniform with respect to the axial direction. However, in the present invention, when the layout is made such that the direction where the center portion of the tip end edge of the control member is bowed substantially coincides with the direction where the first roller is bowed, the center portion of the control member recedes in substantially the same direction as the outer peripheral surface of the bowed first roller, whereby the center portion of the tip end edge and opposite end portions of the same project to substantially the same extent with reference to the tangential direction of the outer peripheral surface. Therefore, the toner scraped to substantially the same thickness as that achieved at opposite end portions of the control member can be caused to enter between the center portion of the control member and the center of the first roller, so that the thickness of the toner on the outer peripheral surface of the first roller can be made uniform with respect to the axial direction.

The contact line may be adapted to be more strongly brought in contact with a center portion of the first roller in the axial direction than opposite end portions of the center portion in the rotating direction.

In this case, the center portion of the tip end edge of the control member is bowed toward and brought into contact with the outer peripheral surface of the first roller. Here, the first roller and the control member are set in such a positional relationship that the first roller is bowed in a direction in which the second roller is brought into contact with and then separates from the first roller, and that the control member scrapes the toner on the outer peripheral surface of the first roller, which is rotated so as to head to the control member, by use of the tip end edge. Therefore, provided that the first roller is bowed and that the tip end edge of the control member is straight, the center portion of the tip end edge substantially projects from opposite end portions thereof with reference to the tangential direction of the outer peripheral surface of the bowed first roller. The toner scraped to a thickness greater than that achieved in opposite end portions of the tip end edge enters the center portion of the tip end edge and the outer peripheral surface of the first roller, thereby resulting in a failure to make the thickness of the toner uniform with respect to the axial direction. However, in the present invention, when the layout is arranged such that the direction in which the center portion of the tip end edge of the control member is bowed substantially coincides with the direction in which the first roller is bowed, the center portion of the control member recedes in substantially the same direction and in the same manner as does the outer peripheral surface of the first roller while being bowed toward the first roller and deformed so as to follow the outer peripheral surface of the first roller, thereby adjusting the extent to which the opposite end portions of the tip end edge project. The shape of the tip end edge with respect to the first roller can be adjusted by the curvature of the control member and the extent to which the tip end edge projects. The tip end edge is matched in shape with the shape of the apparatus, thereby making the thickness of the toner remaining after scraping highly uniform with respect to the axial direction. Accordingly, the toner scraped, with high accuracy, to substantially the same thickness as that achieved by opposite end portions of the tip end edge can be caused to enter between the control member and the center portion of the first roller. The thickness of the toner on the outer peripheral surface of the first roller can be made uniform, with high accuracy, with respect to the axial direction.

The image forming apparatus may further comprises a patch sensor, detecting density information of the toner image, and a controller, adjusting density of the toner to be adhered onto the image carrier in association with the density information. The patch sensor may be arranged at a position corresponding to a position in a peripheral surface of the first roller at which less toner tends to be adhered.

In this case, the control member makes the thickness of the toner adhering to the outer peripheral surface of the first roller constant with respect to the axial direction. However, in view of the shape of the control member, the density of the developed toner image is detected by the patch sensor placed at a location where the thickness of the toner becomes minimum, and the density of the toner used for developing the electrostatic latent image on the surface of the image carrier is adjusted. Consequently, while the thickness of the toner adhering to the outer peripheral surface of the first roller is being made constant with respect to the axial direction, the density of toner is adjusted by reference to the location where the toner image becomes thinnest, thereby developing an electrostatic latent image on the surface of the image carrier without involvement of irregularities in quality with respect to the axial direction of the development roller.

A distance between opposite end portions of the tip end edge in the rotating direction and the contact line may be greater than a distance between a center portion between the opposite end portions and the contact line, and the patch sensor may be arranged so as to detect the toner information of the toner image that is developed with the toner corresponding to the center portion.

In this case, at the location where the tip end edge of the control member has receded to the rearmost position to thus form a gap between the control member and the outer peripheral surface of the first roller, the tip end edge projects the shortest distance in the tangential direction of the outer peripheral surface of the first roller. Hence, the toner that has been scraped to a thinner layer than that achieved in other locations of the control member enters the gap. The location where the thickness of the toner is adjusted so as to become small is set with respect to the axial direction of the first roller by utilization of the above-described mechanism, whereby the control member makes the thickness of the toner over the entire axial length of the first roller constant. From this fact, the patch sensor detects the density of the toner image developed in the location where the toner, whose thickness is to become uniform with respect to the axial direction of the first roller, becomes thinnest. The controller adjusts the density of toner by reference to this location. Consequently, the toner image does not become light, and the quality of the image can be adjusted.

A contact pressure of the control member may be not constant relative to the axial direction of the first roller.

In this case, the pressure by means of which the control member is brought into compressed contact with the outer peripheral surface of the first roller is varied from the opposite end portions of the control member to the center portion of the same. Put another way, the center potion or opposite end portions of the tip end edge of the control member are curved toward and brought into compressed contact with the outer peripheral surface of the first roller. Thereby, the thickness of the toner that enters between the outer peripheral surface of the first roller and the control member after the toner has been scraped by the tip end edge can be adjusted with respect to the axial direction of the first roller. Consequently, for instance, the control member is curved in accordance with the degree of deflection of the first roller, so that the thickness of the toner entering between the control member and the outer peripheral surface of the first roller can be made uniform with respect to the axial direction by means of adjusting the shape of the tip end edge with respect to the first roller in accordance with the curvature of the control member and the extent to which the control member projects. The density of the toner image developed with the toner that is more uniform with respect to the axial direction, on the outer peripheral surface of the first roller is further adjusted to thus develop the electrostatic latent image on the surface of the image carrier with higher quality.

The patch sensor may be arranged so as to detect the toner information of the toner image that is developed with the toner having been held at a position in the peripheral surface of the first roller at which the contact pressure is most strongly applied.

In this case, at the location of the control member (the tip end edge) that is brought into compressed contact with the first roller with large compressing force, the control member comes closest to the outer peripheral surface of the first roller, to thus form a gap. Hence, the toner that been scraped to a thinner layer than that achieved in other locations of the control member enters the gap. The location where the thickness of the toner is adjusted so as to become small is set with respect to the axial direction of the development roller by utilization of the above-described mechanism, whereby the control member makes the thickness of the toner over the entire axial length of the first roller constant. From this fact, the patch sensor detects the density of the toner image developed in the location where the toner, whose thickness is to become uniform with respect to the axial direction of the first roller, becomes thinnest. The controller adjusts the density of toner by reference to this location. Consequently, the toner image does not become thin, and the quality of the image can be adjusted.

Here, the first roller and the control member are set in such a positional relationship that the first roller is bowed in a direction in which the second roller comes into compressed contact with and then separates from the first roller, and that the control member scrapes the toner on the outer peripheral surface of the first roller, which is rotated so as to head to the control member, by use of the tip end edge.

Therefore, provided that the first roller is bowed and that the tip end edge of the control member is straight, the center portion of the tip end edge substantially projects from opposite end portions thereof with reference to the tangential direction of the outer peripheral surface of the bowed first roller. The toner scraped to a thickness greater than that achieved in opposite end portions of the tip end edge enters the center portion of the tip end edge and the outer peripheral surface of the first roller, thereby resulting in a failure to make the axial thickness of the toner uniform. However, in the present invention, when the layout is arranged such that the direction in which the center portion of the tip end edge of the control member recedes substantially coincides with the direction in which the first roller is bowed, the center portion of the control member recedes in substantially the same direction and in the same manner as does the outer peripheral surface of the first roller, whereby the center portion of the tip end edge and opposite end portions of the same project to substantially the same extent with reference to the tangential direction of the outer peripheral surface of the first roller. Accordingly, the toner, which has been scraped to substantially the same thickness as that achieved between opposite end portions of the tip end edge and the first roller, can be caused to enter between the control member and the center portion of the first roller. Thus, the thickness of the toner on the outer peripheral surface of the first roller can be made uniform with respect to the axial direction. Concurrently, the control member is brought into compressed contact with the first roller bowed in an escaping direction, to thus be bent. As a result, the tip end edge and the first roller can be caused to approach each other such that opposite end portions of the tip end edge and the center portion of the same follow the first roller. The gap defined between the tip end edge and the first roller can be of constant thickness with respect to the axial direction, thereby making the toner on the outer peripheral surface of the first roller uniform.

As mentioned above, according to the present invention, by means of merely causing the extent to which the center portion of the tip end edge of the control member projects to vary or recede from the extent to which opposite end portions of the tip end edge of the same project, the thickness of the toner on the outer peripheral surface of the first roller, which is left after the toner has been scraped by the tip end edge of the control member and which enters between the control member and the first roller, can be adjusted with respect to the axial direction. Consequently, the thickness of the toner on the outer peripheral surface of the first roller can be made uniform with a simple structure, and the electrostatic latent image on the surface of the image carrier can be developed with high quality by the toner. Concurrently, the center portion of the tip end edge of the control member can be bowed toward (or brought into compressed contact with) the outer peripheral surface of the first roller. In this case, the extent to which the control member is bowed is brought in agreement with the first roller, and the thickness of the toner on the outer peripheral surface of the first roller can also be adjusted more accurately by means of the extent to which the tip end edge of the control member projects.

The patch sensor is placed at the position where the thickness of the toner becomes minimum while the thickness of the toner on the outer peripheral surface of the first roller is constant with respect to the axial direction. Hence, the density of the toner image formed by developing the electrostatic latent image on the surface of the image carrier can be adjusted optimally without involvement of a decrease in density in accordance with the detection information output from the patch sensor. Consequently, the electrostatic latent image on the surface of the image carrier can be developed to a toner image of optimal density, and a high-quality image can be formed.

BRIEF DESCRIPTION OF THE DRAWINGS

FIG. 5 is a view showing a relationship among an image carrier, a development roller, and a supply roller.

FIG. 8 is a view for describing attachment of the control member.

FIG. 9 is a view showing another example of the control member.

DETAIL DESCRIPTION OF PREFERRED EMBODIMENTS

Preferred an embodiment of the present invention will be described hereinbelow by reference to the drawings. FIGS. 1 to 4 are views showing an embodiment of an image forming apparatus of the present invention.

Figure 1:
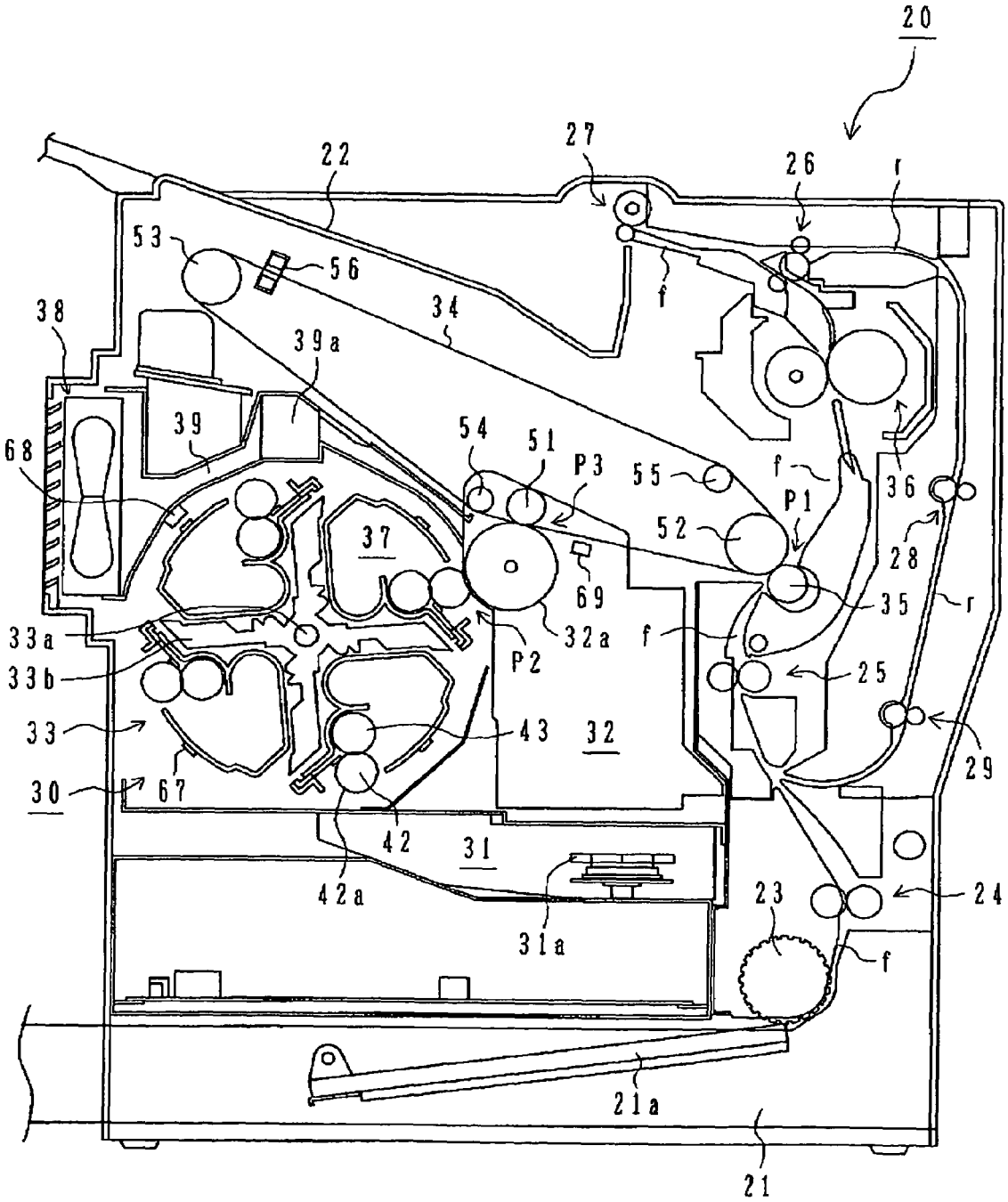
FIG. 1 is a view showing an embodiment of an image forming apparatus of the present invention, or a perspective front view showing a diagrammatic overall configuration of the image forming apparatus.
Figure 2:
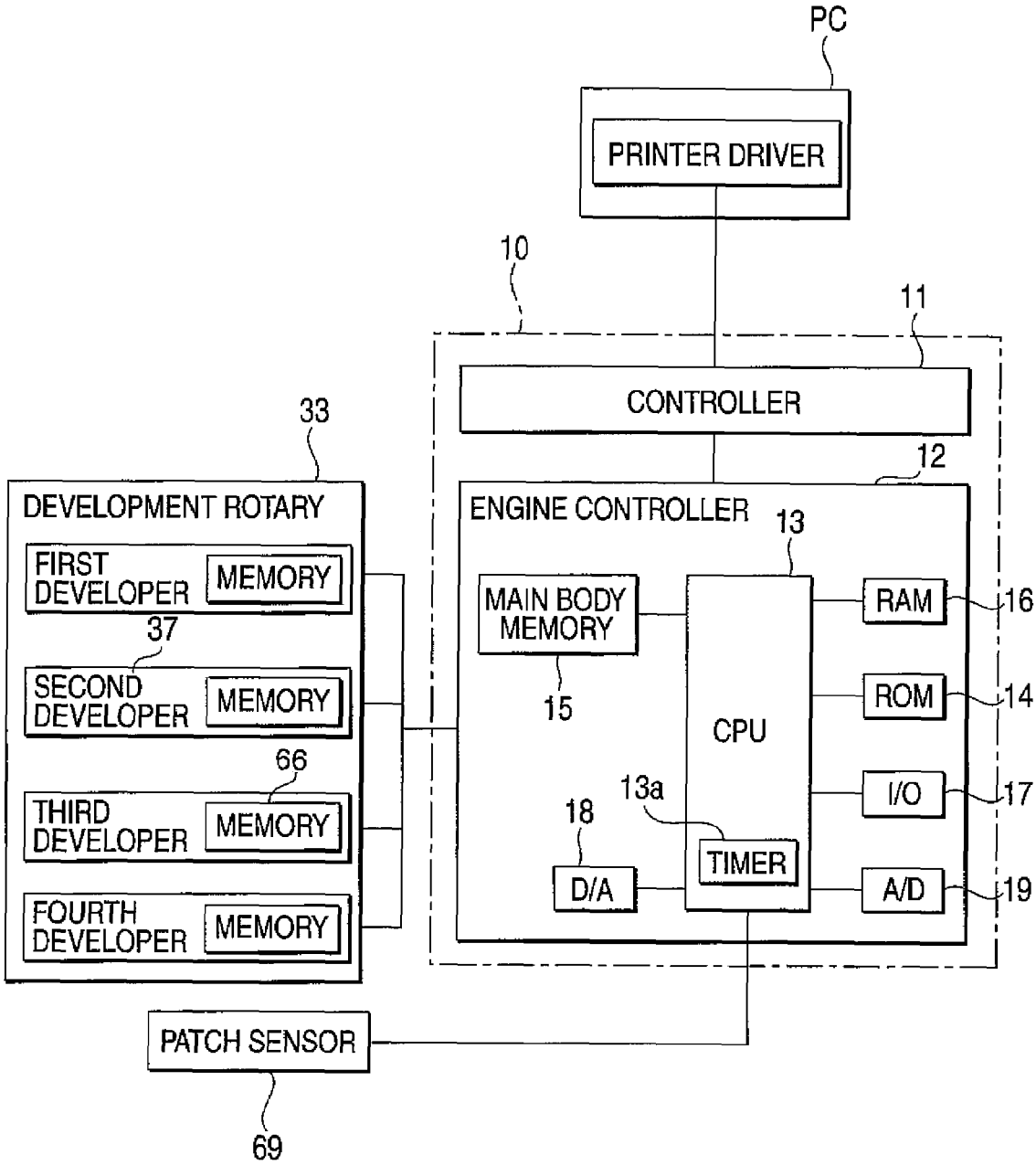
FIG. 2 is a relevant block diagram for describing a controller of the apparatus.

In FIGS. 1 and 2, an image forming apparatus is, for example, a device that forms and outputs an image, such as characters, and is utilized by being connected with a personal computer PC. A control unit 10 connected to the personal computer PC controls a sheet transporter 20 and an image recorder 30 in a centralized manner, thereby forming an image on a recording sheet (recording medium) and printing out it.

The control unit 10 is constituted of a controller 11 and an engine controller 12, which are formed on a circuit board to be incorporated in the main body of the apparatus. They execute various types of data processing control operation and drive control of individual sections of the apparatus in accordance with previously-prepared programs.

In short, an unillustrated CPU executes various types of processing procedures in accordance with processing programs stored in memory, whereby the controller 11 exchanges various types of pieces of information, such as a print command, with a printer driver of the personal computer PC. Further, the controller 11 receives image data, such as text, which are printed on a recording sheet to thus form an image, and temporarily stores the thus-received image data in unillustrated memory. Image data (an image information signal) received from the personal computer PC are so-called RGB data consisting of red (R) data, green (G) data, and blue (B) data. Therefore, the controller 11 reads the RGB data from the memory while converting the thus-read data into printable image data of so-called YMCK data consisting of yellow (Y) data, magenta (M) data, cyan (C) data, and black (K) data, and passes the resultant YMCK data to the engine controller 12.

In accordance with the control program stored in ROM 14, the CPU 13 receives the image data from the controller 11 on, e.g., a per-page basis, and temporarily stores the thus-received image data in main body memory 15. Further, the CPU 13 exchanges various pieces of information with the sheet transporter 20 and the image recorder 30 while using RAM 16 as a work area, whereby the engine controller 12 forms an image on the recording sheet according to the image data. At this time, when performing this image formation control, the CPU 13 causes the individual sections of the apparatus to operate optimally, by means of counting various processing times through use of a built-in timer function (counting means) 13*a*.

In FIG. 2, an I/O interface 17 connects the controller 11, the sheet transporter 20, the image recorder 30, and the engine controller 12 so as to be enable exchange of various pieces of information. A digital-to-analog converter 18 and an analog-to-digital converter 19 convert a digital (D) signal into an analog (A) signal, and an analog signal into a digital signal, so that various pieces of information, which are exchanged by the engine controller 12 with respect to the controller 11, the sheet transporter 20, and the image recorder 30, can be respectively processed thereby.

In addition to being constituted of a sheet cassette 21, a sheet discharge table 22, a pickup roller 23, a pair of transport rollers 24, a pair of registration rollers 25, a pair of switching rollers 26, a pair of sheet discharge rollers 27, and pairs of reverse rollers 28, 29, the sheet transporter 20 is formed from an intermediate transfer belt 34, a transfer roller 35, and a pair of fusing rollers 36, which are constituent elements of the image recorder 30. This sheet transporter 20 separately transports a plurality of recording sheets loaded in the sheet cassette 21 one at a time to a position P1 where an image is formed and recorded by the image recorder 30. After received image data, such as characters, have been formed and recorded on a single face or double faces of the recording sheet, the recording sheet, on which the image has already been formed, is transported to the outside of the apparatus, and the thus-transported sheet is loaded onto the sheet discharge table 22.

In brief, the pickup roller 23 rotates while remaining in compressed contact with the recording sheets loaded on a lift plate 21*a* within the sheet cassette 21, thereby withdrawing the recording sheets and separating the same one at a time in cooperation with an unillustrated separator, and feeding the thus-separated recording sheet to a transport path f. The pair of transport rollers 24 transport the recording sheet in a nipped manner, thereby bringing the extremity of the recording sheet into collision with a nip section of the pair of downstream registration rollers 25 to thus eliminate any skew. The pair of registration rollers 25 feed the recording sheet in a nipped manner to the position P1 in synchronicity with operation of the image recorder 30.

At this position P1, the intermediate transfer belt 34 and the transfer roller 35 rotate while nipping the fed recording sheet, thereby transporting the recording sheet. Further, the toner image, which has been formed by the image recorder 30 to be described later and transferred onto the intermediate transfer belt 34 through primary transfer, is transferred onto one face of the recording sheet through secondary transfer, to thus form and record an image. The pair of fusing rollers 36 rotate while nipping the recording sheet, to thus transport the recording sheet further downstream and fix the image on the recording sheet.

Subsequently, the pair of switching rollers 26 and the pair of sheet discharge rollers 27 transport and load the recording sheet transported from the pair of fusing rollers 36 onto the sheet discharge table 22. Thus, while one face of the recording sheet is taken as a face where an image is to be formed and recorded, the recording sheet is transported to the position P1 where an image is formed by the image recorder 30, whereby an image is formed on one face. The recording sheet is then discharged to the sheet discharge table 22.

At this time, in a case where a double-faced mode, in which images are formed on respective faces of the recording sheet, is ordered by the engine controller 12, the sheet transporter 20 temporarily stops at a position where the pair of sheet discharge rollers 27 nip a trail edge of the recording sheet transported onto the sheet discharge table 22, and is reversely driven in conjunction with the pair of switching rollers 26, to thus feed the recording sheet of which the image has been formed and recorded on one face, to a reverse path r.

The pairs of reverse rollers 28, 29 transport and cause the recording sheet to pass through the reverse path "r" in a nipped manner. Thereby, the recording sheet is turned upside down while the edge thereof having been taken as a trailing edge during formation of an image on one face is taken in reverse as a leading edge. The recording sheet is again fed to the transport path f and passed to the pair of registration rollers 25. While the remaining face of the recording sheet (i.e., the face on which an image is not formed and recorded) is taken as a face where an image is to be formed and recorded, the recording sheet is again fed to the position P1 where an image is formed by the image recorder 30, whereby images are formed on double faces. The recording sheet is then discharged onto the sheet discharge table 22.

The image recorder 30 has an exposure unit 31, a photosensitive member cartridge 32, a development rotary 33, the intermediate transfer belt 34, the transfer roller 35, and the pair of fusing rollers 36. This image recorder 30 forms and records, by means of an electrophotographic system, the received image data, such as characters, on one face or double faces of the recording sheet transported to the position P1 by the sheet transporter 20.

In brief, in accordance with the image data received by a laser beam scanning device (a polygon mirror) 31*a* housed in the exposure unit 31, the exposure unit 31 selectively radiates a laser beam onto the surface of a photosensitive drum (image carrier) 32*a* in the photosensitive member cartridge 32, to thus subject the photosensitive drum 32*a* to scanning exposure. As a result, an electrostatic latent image produced from the image data is formed (made) on the surface of the photosensitive drum 32*a*. Development cartridges 37 of respective colors, which develop the electrostatic latent image on the photosensitive drum 32*a* with toner of yellow (Y), cyan (C), magenta (M), and black (K) colors, are housed in the development rotary 33 in an insertable/detachable (removable) manner. The development cartridges (developers) 37 are caused to come to a development position P2 where the development cartridge 37 opposes the photosensitive drum 32*a*, in accordance with the image data which are used for forming the electrostatic latent image, thereby causing the housed toner to adhere onto the photosensitive drum 32*a*. Thus, the electrostatic latent image is developed with toner.

In the case of, e.g., a monochrome image, the intermediate transfer belt 34 receives the toner image, which has been formed from black (K) toner on the photosensitive drum 32*a*, by means of primary transfer, at a transfer position P3 where the intermediate transfer belt opposes the photosensitive drum 32*a*. The toner image to be transferred onto the recording sheet is held on the surface of the intermediate transfer belt. In the case of a color image, this intermediate transfer belt 34 receives toner images, which are formed from yellow (Y), cyan (C), and magenta (M) toner on the photosensitive drum 32*a*, in sequence (the sequence is not limited to Y, C, and M) at the transfer position P3 in such a way that the toner images are laid over the surface of the intermediate transfer belt, to thus form and retain a color toner image to be transferred onto the recording sheet. The transfer roller 35 transports in a nipping manner the recording sheet, which has been fed to the position (i.e., the position P1) between the transfer roller 35 and the intermediate transfer belt 34, while nipping the same, thereby transferring the toner image on the intermediate transfer belt onto the recording sheet by means of secondary transfer. The toner is transferred from the development cartridge 37 to the recording sheet by way of the photosensitive drum 32*a* and the intermediate transfer belt 34, in accordance with a bias voltage applied between the members.

The pair of fusing rollers 36 heat and come into compressed contact with the recording sheet transported from the position P1 in a nipped manner to thus fuse the toner image developed and transferred in the development position P2 and the transfer position P3, and transport the recording sheet further downstream in a nipped manner. Thereby, a monochrome image or a color image, which is produced from the received image data, is formed and recorded (fixed) on one face or double faces of the recording sheet. By means of repetition of these operations, an image can be consecutively formed anf recorded on a plurality of sheets.

The toner still remaining on the photosensitive drum 32*a* after transfer of the toner image to the intermediate transfer belt 34 is subjected to antistatic electrification performed by an unillustrated cleaning device, whereupon the toner is recovered by the cleaning device. Subsequently, the photosensitive drum 32*a* is electrified, by means of an electrification device, to such an electric potential as to receive toner from the development cartridge 37 of the development rotary 33 and to cause the thus-received toner to adhere to the photosensitive drum 32*a*. The intermediate transfer belt 34 is similarly subjected to antistatic electrification/electrification, whereby transfer (adhesion)/recovery of toner is repeated. The toner which splashes during recovery operation is captured by a filter 39*a* attached to an exhaust duct 39 as a result of a suction fan 38 drawing air from the main body of the apparatus by way of the exhaust duct 39.

The development rotary 33 is constituted by means of housing (placing), in housing positions partitioned by a partition frame 33*b* which rotates around a rotary shaft 33*a*, the plurality of development cartridges 37 for developing, by use of toner, an electrostatic latent image on the surface of the photosensitive drum 32*a*. In accordance with a print command, which includes the image data received by the CPU 13 of the engine controller 12 from the personal computer PC by way of the controller 11, the development rotary 33 is rotated around the rotary shaft 33*a*, thereby switching the development cartridge 37 to be located in the development position P2 where the development cartridge 37 faces the photosensitive drum 32*a*. Thus, the toner image, which is to be transferred onto one or double faces of a recording sheet to form an image, is developed.

For instance, in this image forming apparatus, the development cartridges 37 housing toner of respective colors yellow (Y), cyan (C), magenta (M), and black (K) are contained in the development rotary 33. This development rotary 33 is rotated to thus switch the development cartridge 37 used for developing an electrostatic latent image on the photosensitive drum 32*a* such that stored toner of respective colors is selected or superimposed one on top of the other. Thus, the image forming apparatus can be utilized as an apparatus capable of forming images in the range from a color image to a monochrome image.

This image forming apparatus is also configured to be able to form an image even when all the development cartridges 37 contain toner of a single color. For instance, four development cartridges 37 containing toner of black (K) color can be attached to the development rotary 33. In this case, the image forming apparatus can be utilized as a monochrome-only machine which rotates the development rotary 33 to thus sequentially switch the development cartridges 37, which develop an electrostatic latent image on the photosensitive drum 32*a*, and consecutively print a monochrome image. For instance, the development cartridges 37 are switched as required, in accordance with the received image data, thereby enabling performance of convenient image forming operation.

Figure 3:
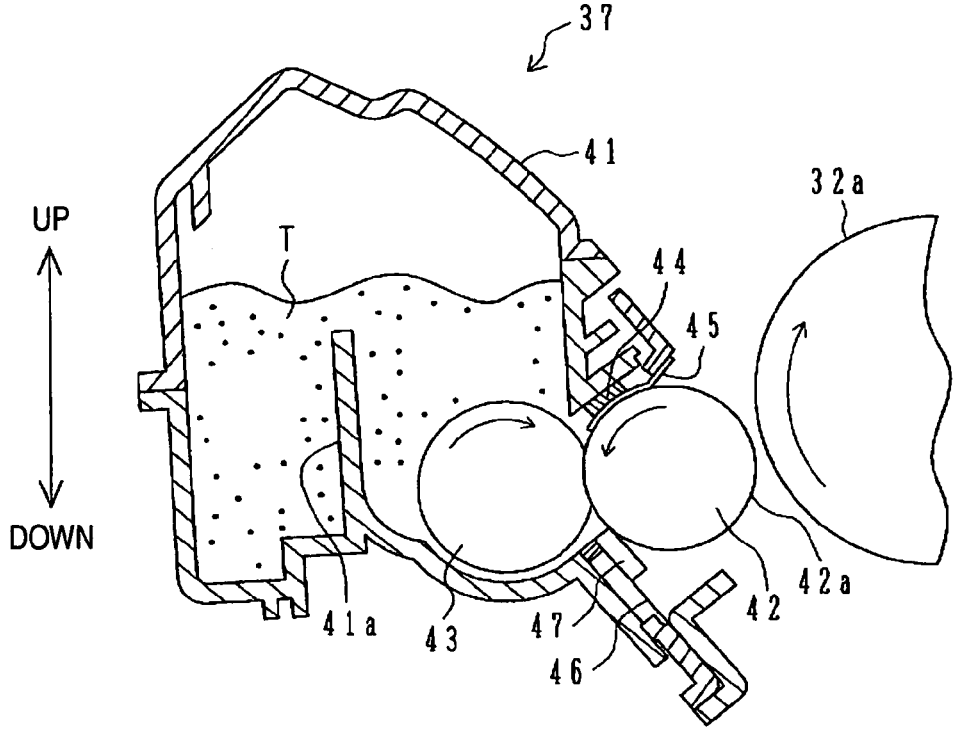
FIG. 3 is a vertical cross-sectional view showing the configuration of the principal section of the apparatus.

As shown in FIG. 3, each of the development cartridges 37 has a container 41, a development roller 42, and a supply roller 43. The container 41 is formed to be geometrically similar to each of the housing spaces (positions) partitioned by the partition frame 33*b* of the development rotary 33, so that toner T is housed in the respective housing spaces. The development roller 42 is rotatably supported at a position close to the outer periphery of the container 41 spaced apart from the rotary shaft 33*a* of the development rotary 33, and causes the toner T supplied from the supply roller 43 to adhere to the opposing photosensitive drum 32*a*. The supply roller 43 is supported by the container 41 so as to adjoin the portion of the development roller 42 facing the rotary shaft 33*a* of the development rotary 33. As a result of rotating in a compressed manner along with the development roller 42, the supply roller 43 supplies the toner T located around the roller. In the container 41 of the development cartridge 37, a partition plate 41*a* is provided at a position adjacent to the supply roller 43. This partition plate 41*a* partitions the housing space of the toner T in the container 41 while maintaining communication between the space close to the rotary shaft 33*a* and a position above the space, where the supply roller 43 is provided. Namely, the supply roller 43 constitutes common supply member for supplying the toner T to an outer peripheral surface 42*a* of the development roller 42. Needless to say, the supply member is not limited to such a roller-type means but may supply the toner T with another system.

By means of this configuration, the development cartridge 37 supplies, to the development roller 42 rotated by the supply roller 43 in a compressed manner, the toner T in the space on the outer peripheral portion of the container 41 partitioned by the partition plate 41*a*. Moreover, when the development rotary 33 has rotated through 180 degrees in a counterclockwise direction in FIG. 1 in increments of 90 degrees, the development cartridge 37 mixes together, at a position above the partition plate 41*a* (a lower position in FIG. 1), the toner T located in the part of the container 41 closer to the rotary shaft 33*a* and the toner T located on the part of the container 41 closer to the supply roller 43. Subsequently, the development rotary 33 further rotates in increments of 90 degrees, thereby stirring and refreshing the toner T stored in the container 41 and collecting the stored toner T toward the supply roller 43 so that the toner T can be supplied to the development roller 42. Specifically, in the development cartridge 37 attached to the development rotary 33 that rotates in the manner as mentioned above, the stored toner T is supplied to the supply roller 43 by means of rotation of the development rotary 33 while being stirred. Hence, an adjustment device (a so-called agitator or auger) used for adjustment operation, such as stirring or replenishing of the stored toner T, can be omitted as required. However, in a case where the adjustment device is omitted, the development cartridge 37 must replenish or stir the toner T by means of rotating the development rotary 33 before at least the toner T to be supplied to the development roller 42 becomes depleted around the supply roller 43; for example, when the used amount of toner T, which is detected from a count value output from a toner counter, the number of dots of an image, a development (image formation) time to be totaled, the number of developed sheets to be totaled, or the amount of remaining toner T actually measured, has exceeded a predetermined value.

In this development cartridge 37, the development roller 42 is exposed from the inside of the container 41 so as to oppose the photosensitive drum 32*a* at the development position P2. In a gap defined between the outer peripheral surface 42*a* of the development roller 42 and the opening section of the container 41, there are provided a seal member 45 which is urged by an urging member 44, such as a rubber material, and formed from a resin material to be brought into compressed contact with the outer peripheral surface 42*a*, and a control blade (control member) 47 which is urged by an urging member 46, such as a leaf spring, and formed from a rubber material (rubber) to be brought into compressed contact with the outer peripheral surface 42*a* of the development roller 42.

Figure 4:
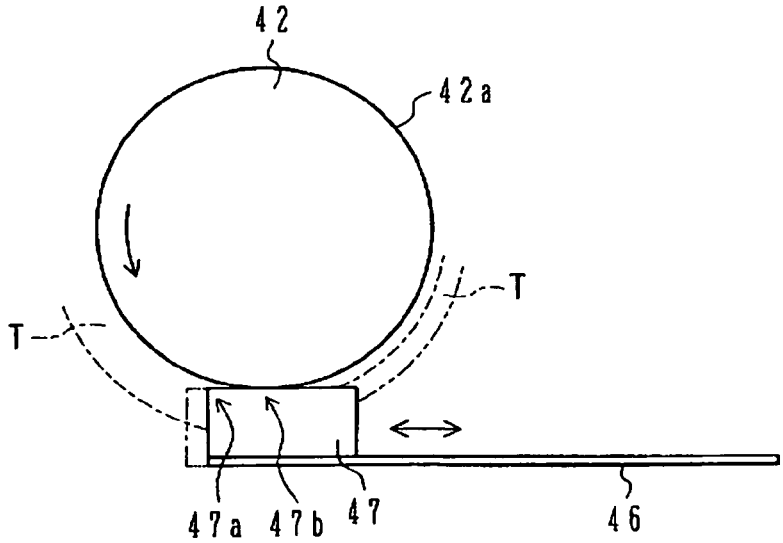
FIG. 4 is a side view obtained when a relationship between a development roller and a control member is viewed in an axial direction.

The seal member 45 prevents leakage of the toner T to the outside of the container 41; and recovers, into the container 41, the toner T from the outer peripheral surface 42*a* of the development roller 42 having passed by the development position without scraping the toner. The control blade 47 is formed into the form of a strip extending in the axial direction of the development roller 42. As shown in FIG. 4, when the control blade 47 is illustrated for easy comprehension, a plane portion 47*b*, which is located on a rear end part of the control blade 47 relative to a tip end edge 47*a* located at a leading-end part of the same, is adjusted so as to come into compressed contact with the outer peripheral surface 42*a* of the development roller 42. Thereby, the toner T, which is adhered to the outer peripheral surface 42*a* and is rotated so as to head to the control blade 47, is scraped by the tip end edge 47*a*, to thus control the thickness of the toner to a fixed value.

The position where the plane portion 47*b* is brought into compressed contact with the outer peripheral surface 42*a* of the development roller 42 is adjusted in a tangential direction (a horizontal direction in FIG. 4), whereby the control blade 47 can control the extent to which the toner T adhering to the outer peripheral surface 42*a* is scraped by the tip end edge 47*a*. For instance, when the position where the plane portion 47*b* is brought into compressed contact with the outer peripheral surface 42*a* of the development roller 42 is set to the neighborhood of a midpoint position of the plane portion 47*b*, the thickness of the toner T is controlled to a level indicated by a dashed line in FIG. 4. In contrast, as indicated by a chain double-dashed line shown in FIG. 4, when the position where the plane portion 47*b* is brought into compressed contact with the outer peripheral surface 42*a* is set to a forward point of the plane portion 47*b* (a left point in FIG. 4), the gap defined between the tip end edge 47*a* and the outer peripheral surface 42*a* is broadened, thereby making thicker the toner T entering the gap. The toner T over the outer peripheral surface 42*a* of the development roller 42 is to be electrified by application of a preset electrification voltage to the control blade 47. Even when the supply roller 43 is rotated while remaining in compressed contact with the development roller 42, the toner is frictionally electrified to some extent.

Figure 5A:
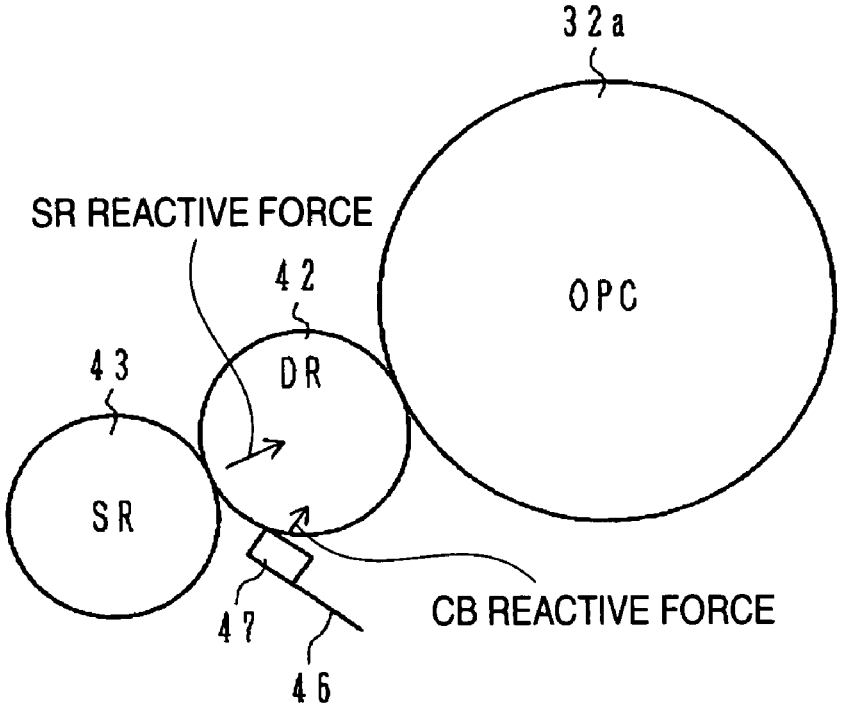
FIG. 5A is a side view obtained when these elements are viewed in the axial direction.
Figure 5B:
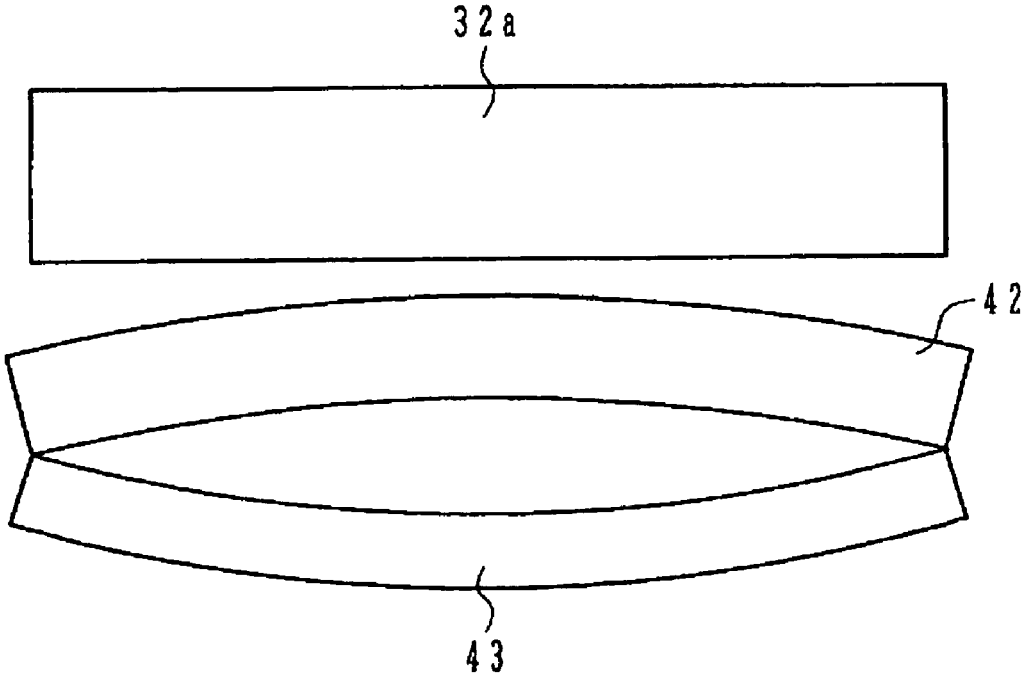
FIG. 5B is a plan view obtained when the elements are viewed in the normal direction.
Figure 6:
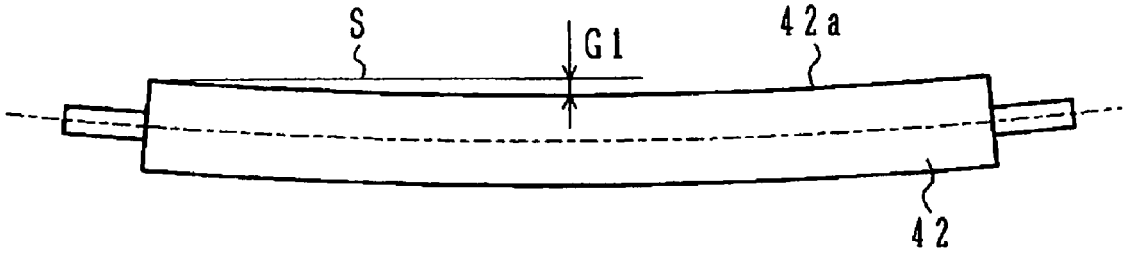
FIG. 6 is a plan view for describing a curve of the development roller.

Here, opposite ends of the development roller 42 are rotatably supported. As shown in FIG. 5A, the supply roller 43 remains in compressed contact with the development roller 42 from the back side of the photosensitive drum 32*a*, and the control blade 47 also remains in compressed contact with the development roller 42 in substantially the same direction. As illustrated in an exaggerated manner in FIG. 5B, a center portion of the development roller 42 is deformed and bowed so as to escape from the supply roller 43 and the control blade 47. For example, as shown in FIG. 6, in the case of the development roller 42 set to a length (250 mm to 350 mm or thereabouts) corresponding to an A4-size or A3-size recording sheet, the development roller 42 becomes deformed such that a gap G1 on the order of micrometers to tens of micrometers is formed in the center portion with reference to a straight outer peripheral surface S. Consequently, the development roller 42 is in a state where the center portion thereof escapes from a nip face of the control blade 47 in a separating direction. For this reason, when tip end edge of the control blade 47 is straight, the toner T adhering to the outer peripheral surface 42*a* of the development roller 42 is scraped to a greater depth from the center portion than from opposite ends of the development roller 42, thus resulting in a failure to make the thickness of the toner uniform.

Figure 7:
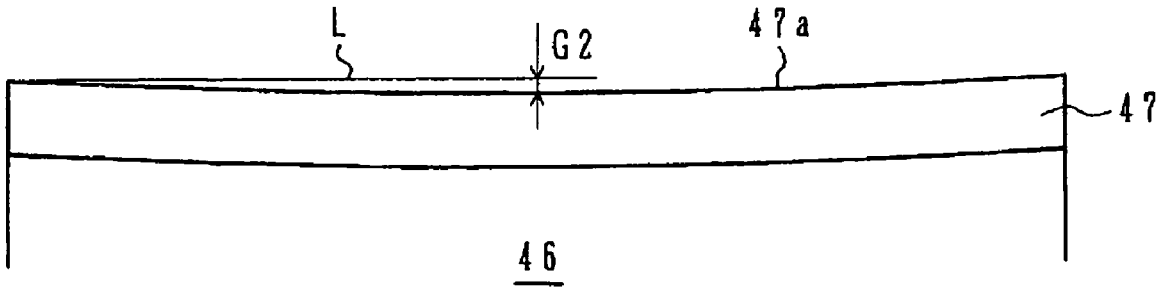
FIG. 7 is a plan view for describing the shape of the control member.

Therefore, the control blade 47 is formed such that the extent to which the tip end edge 47*a* protrudes in the tangential direction of the outer peripheral surface 42*a* of the development roller 42 varies from the center portion to opposite ends of the development roller 42. In more detail, in the case of the control blade 47 whose length complies with the A4-size and A3-size recording sheet, the control blade 47 is formed into a bow shape as shown in FIG. 7, where the center portion of the tip end edge 47*a* recedes backward from opposite ends of the same so as to form a gap G2, which is on the order of micrometers to hundreds of micrometers, with reference to a straight line L in the tangential direction of the outer peripheral surface 42*a* of the development roller 42.

The control blade 47 can make the extent to which the tip end edge 47*a* protrudes forward in the tangential direction from the position where the control blade 47 opposes the outer peripheral surface 42*a* of the development roller 42, smaller in the center portion of the control blade 47 in relation to opposite ends of the same (can cause the center portion of the tip end edge 47*a* to recede backward from opposite ends of the same). The thickness of the toner T, which is located in the center portion, scraped by the tip end edge 47*a*, and caused to enter between the development roller 42 and the plane portion 47*b*, can be made relatively smaller than that achieved at opposite ends of the control blade 47. Put another way, the control blade 47 can be set so as to be able to make axially uniform the gap defined between the tip end edge 47*a* and the outer peripheral surface 42*a* of the development roller 42 and to uniformly scrape the toner T off from the outer peripheral surface 42*a*. Therefore, the toner T, which becomes thicker in the center portion of the outer peripheral surface 42*a* of the development roller 42 because of a curvature in the development roller 42, is scraped such that the thickness achieved in the center portion of the development roller 42 becomes equal to that achieved in opposite ends of the same, to thus achieve a uniform thickness in the axial direction.

Specifically, the requirement is to manufacture the control blade 47 into a desired arcuate shape in accordance with the extent of deflection of the development roller 42 such that the center portion of the tip end edge 47*a* recedes from opposite ends of the same. For instance, the leaf spring (urging member) 46, which measures 0.5 to 0.2 mm or thereabouts and is formed from phosphor bronze or stainless steel, is set in a mold having a molding face of desired curvature, and a rubber material is injected into the mold, to thus form the control blade 47 integrally with the leading end of the leaf spring 46. This control blade 47 can also be manufactured by means of affixing a rubber material, which is cut into the shape of a strip, to the leading end of the leaf spring 46 while maintaining the rubber material in intimate contact with a jig having the shape of a desired curvature. When the leaf spring itself is formed into a control blade, the leaf spring may be punched with a press die so as to have a tip end edge of desired curvature shape.

Figure 8A:
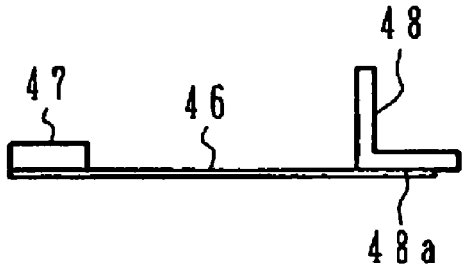
FIG. 8A is a side view of the control member.
Figure 8B:
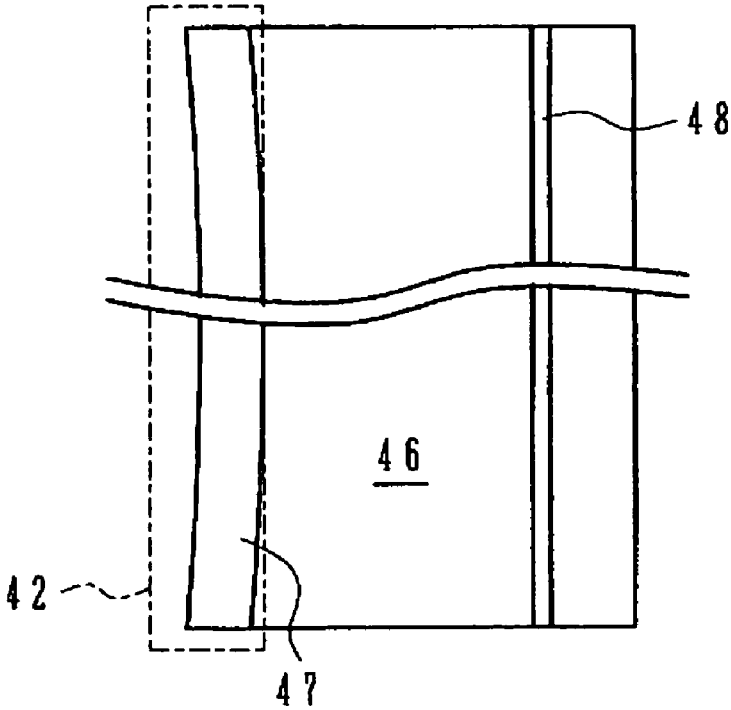
FIG. 8B is a plan view of the control member.
Figure 8C:
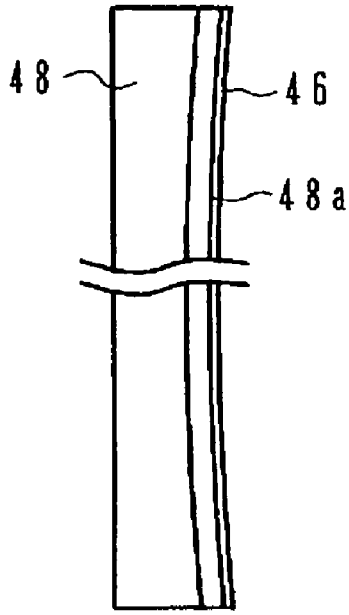
FIG. 8C is an elevation view of the control member when viewed from the back.

As shown in FIGS. 8A and 8B, a frame 48 to be fastened to the container 41 of the development cartridge 37 is fixedly provided on the part (the rear-end part) of the leaf spring 46 opposite the part thereof where the control blade 47 is provided (i.e., the leading-end part of the leaf spring 46). This frame 48 is formed into the same width as that of the leaf spring 46. As shown in FIG. 8C, a longitudinal center portion of a mount face 48*a*, where the frame 48 is to be fastened, is curved into a concave surface. The leaf spring 46 is fixed to the mount face 48*a* by means of spot-welding a plurality of points of the leaf spring 46.

Thereby, when the control blade 47 comes into compressed contact with the outer peripheral surface 42*a* of the development roller 42, the curved shape of the rear-end center portion (the mount face 48*a*) of the leaf spring 46 acts so as to cause the center portion of the tip end edge 47*a* to protrude toward the outer peripheral surface 42*a*. Therefore, the center portion of the control blade 47 tends to approach the center portion of the development roller 42 which is bent in an escaping direction by means of coming into compressed contact with the supply roller 43. Namely, the center of the control blade 47 comes into compressed contact with the outer peripheral surface 42*a* of the development roller 42 with compressing force which is higher that achieved in opposite axial ends of the outer peripheral surface 42*a*. The tip end edge 47*a* is caused to approach the outer peripheral surface 42*a* of the development roller 42, thereby scraping the toner T adhering to the peripheral surface 42*a* to an accurate, uniform thickness. At this time, as a result of the control blade 47 coming into compressed contact with the development roller 42, a departing force originating from the frame 48 acts on the leaf spring 46, thereby stretching the leaf spring 46 in a direction to expand the interval among the spot welds; in other words, in a direction where ridges and slack between the spot welds are stretched. The control blade 47 can be brought into axially-uniform compressed contact with the outer peripheral surface 42*a* of the development roller 42. The toner T on the outer peripheral surface 42*a* of the development roller 42 can be uniformly scraped by the tip end edge 47*a* of the control blade 47.

Figure 9A:
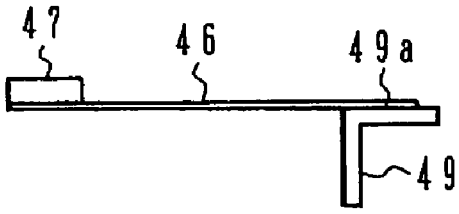
FIG. 9A is a side view of the control member.
Figure 9B:
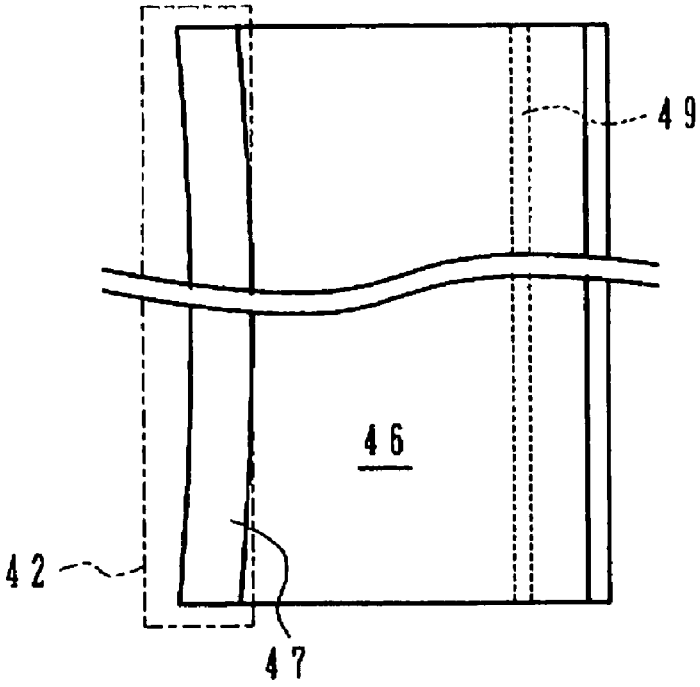
FIG. 9B is a plan view of the control member.
Figure 9C:
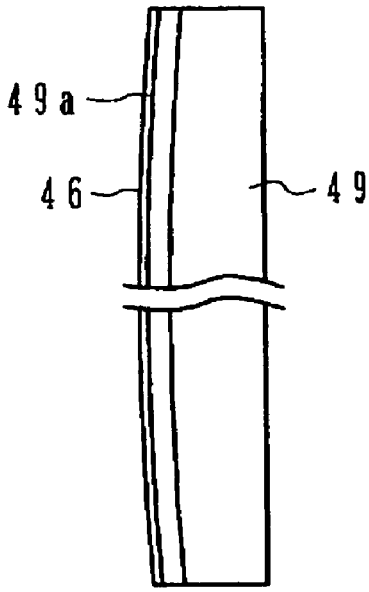
FIG. 9C is an elevation view of the control member when viewed from the back.

As shown in FIGS. 9A and 9B, a frame 49 may be fastened to a back side of a rear end portion of the leaf spring 46 with reference to the control blade 47. This frame 49 is formed to the same width as that of the leaf spring 46. As shown in FIG. 9C, a mount face 49*a* of the leaf spring 46 has a longitudinal center portion which is convexly bowed, and the leaf spring 46 is fixed to the mount face 49*a* of the frame 49 by spot-welding a plurality of points in that mount face. In this case, the leaf spring 46 is spot-welded while being pressed against the mount face 49*a*. When the frame 49, which has remained bent as a result of the leaf spring 46 being pressed, is relieved from the pressing force after completion of welding operation, the frame 49 can be extended in a direction to spread the spot welds; in other words, in a direction to eliminate ridges and slack in the spot welds. As in the case of the frame 48, the control blade 47 is brought into axially-uniform compressed contact with the outer peripheral surface 42*a* of the development roller 42, thereby uniformly scraping the toner T on the outer peripheral surface 42*a*.

The intermediate transfer belt 34 is formed into an endless belt passed around a primary transfer pulley 51, a secondary transfer pulley 52, a driven pulley 53, and tension pulleys 54, 55. The primary transfer pulley 51 is positioned in the primary transfer position P3 where the developed toner image on the photosensitive drum 32*a* is transferred to the intermediate transfer belt 34 by means of primary transfer. The primary transfer pulley 51 faces the photosensitive drum 32*a* via the back side of the intermediate transfer belt 34. The secondary transfer pulley 52 is located in the position P1 where the toner image having been transferred onto the intermediate transfer belt 34 by means of primary transfer is transferred to the recording sheet nipped between the secondary transfer pulley 52 and the transfer roller 35 by means of secondary transfer, to thus form and record an image. The secondary transfer pulley 52 faces the transfer roller 35 via the back side of the intermediate transfer belt 34. The driven pulley 53 is located in a position opposite to the secondary transfer pulley 52 and follows rotation of the intermediate transfer belt 34. The tension pulleys 54, 55 are located on opposite sides of the intermediate transfer belt 34 with reference to an imaginary line connecting the secondary transfer pulley 52 to the driven pulley 53, and exerts tension on the intermediate transfer belt 34 from the back thereof so as to prevent occurrence of positional slippage of the intermediate transfer belt 34.

This intermediate transfer belt 34 is equipped with an unillustrated projection (a so-called shim) which projects outside in the direction of a plane from one side of the intermediate transfer belt. The projection is detected by a sensor 56 every time the intermediate transfer belt 34 rotates, and the CPU 13 of the engine controller 12 controls rotational driving so as to become synchronized with rotation of the photosensitive drum 32*a* and transfer of the recording sheet. As a result, the intermediate transfer belt 34 is rotationally driven so as to oppose the recording sheet transported to the position P1, where the recording sheet opposes the transfer roller 35, as well as to repeatedly circulate along a path between the position P1 and the transfer position P3 where the intermediate transfer belt 34 opposes the photosensitive drum 32*a*. The intermediate transfer belt 34 receives the toner images of respective colors formed on the photosensitive drum 32*a* in the transfer position P3, and transfers the thus-received toner images to the recording sheet in the position P1.

As mentioned above, in contrast with circulatory rotation of the intermediate transfer belt 34, the development rotary 33 must sequentially switch the development cartridges 37 used for developing the toner image during formation of, especially, a color image. For this reason, the intermediate transfer belt 34 is set so as to become longer than the size of the recording sheet on which a color image is to be formed, and holds the toner image to be transferred on the recording sheet. In contrast, the development rotary 33 must complete switching of the development cartridges 37 during a period of time in which a space between the rear and front edges of the toner image on the intermediate transfer belt 34 (a space between the rear and front edges of the recording sheet; that is, a so called a space between sheets) rotatively moves.

Each of the development cartridges 37 incorporates nonvolatile memory 66 and a development-side connector 67. The main body of the development rotary 33 is provided with a control-side connector 68. In addition to the number of times the development cartridge 37 is attached or recycled, various information items, such as the color of toner contained, the date of manufacture of the development cartridge, and the amount of toner consumed, are stored in the nonvolatile memory 66 in a rewritable manner along with identification information such as a production number. The development-side connector 67 is connected to each of the nonvolatile memory devices 66 to thus read and rewrite the information stored in the memory. The control-side connector 68 is placed immovably on an interior wall surface of the development rotary 33 so as to oppose the development-side connector 67 of the development cartridge 37 that has been rotated through 90 degrees in the counterclockwise direction from the development position P2 where the development roller 43 faces the photosensitive drum 32*a*. The control-side connector 68 opposes the development-side connector 67 of the development cartridge 37 that has completed development operation, to thus exchange various information items by means of noncontact communication. Thus, the engine controller 12 of the control unit 10 appropriately ascertains various information items, such as information about the color of toner in the development cartridge 37, along with the presence/absence and position of the development cartridge 37 housed in the housing position of the development rotary 33, thereby performing image forming control operation including switching control of the optimal development cartridge 37.

After power has been turned on, the CPU 13 of the engine controller 12 is to execute various control operations in accordance with the control program stored in the ROM 14. At turn-on or at the time of replacement of the development cartridge 37, information about the presence/absence of the development cartridge 37 in the housing position in the development rotary 33 and the number of times the development cartridge 37 is attached or recycled is retained (stored) in the main body memory 15 through noncontact communication via the connectors 67, 68. The CPU 13 sequentially reads the various information items written in the nonvolatile memory 66 of each of the development cartridges 37 via the connectors 67, 68; and retains the positional information about the respective development cartridge 37, information about the color of toner, the amount of toner consumption (or the amount of remaining toner), and the like in the main body memory 15. After during the course of image forming operation or completion of image forming operation, the CPU 13 writes various information items, such as the amount of toner consumed by the image forming operation, are rewritten into the nonvolatile memory 66 of each of the development cartridges 37 via the connectors 67, 68.

The CPU 13 of the engine controller 12 is connected to a so-called patch sensor 69 formed from a reflection-type photosensor which emits light toward a transfer surface (a toner image) on the intermediate transfer belt 34 and subjects the light reflected from the toner image on the transfer surface to photoelectric conversion, to thus detect the density (a percentage of an image coated with toner) of the toner image (the toner image on the intermediate transfer belt 34) formed on the photosensitive drum 32*a* by the development cartridge 37. This patch sensor 69 is located in a position in the vicinity of the transfer position P3, where the toner image is transferred from the photosensitive drum 32*a* to the intermediate transfer belt 34, and downstream with reference to the rotating direction of the intermediate transfer belt. As will be described later, the patch sensor 69 is disposed in one location in the vicinity of the widthwise center portion (the vicinity of the center of the photosensitive drum 32*a*) of the outer peripheral surface 42*a* of the development roller 42 which develops an electrostatic latent image on the photosensitive drum 32*a*, the center portion being set such that the thickness of the toner on the outer peripheral surface 42*a* becomes lowest.

However, as mentioned previously, the center of the tip end edge 47*a* of the control blade 47 is caused to recede from opposite ends of the tip end edge 47*a* in the tangential direction of the outer peripheral surface 42*a* so as to scrape the toner on the outer peripheral surface 42*a* of the development roller 42 to a uniform thickness. However, the extent to which the tip end edge 47*a* projects is set in consideration of the fact that the patch sensor 69 for detecting the density of the toner image is arranged in the vicinity of the center of the photosensitive drum 32*a*. In detail, in the tip end edge 47*a* of the control blade 47, the center portion of the tip end edge 47*a* is caused to recede from opposite ends of the same in the tangential direction of the outer peripheral surface 42*a* of the development roller 42 such that the thickness of the toner located on opposite sides of the outer peripheral surface 42*a* of the development roller 42 becomes equal to or greater than the thickness of the toner located in the center of the outer peripheral surface 42*a*.

At turn-on or during replacement of the development cartridge 37, the CPU 13 is to perform patch processing for adjusting a bias voltage used for causing the toner on the outer peripheral surface 42*a* of the development roller 42 to transfer to the photosensitive drum 32*a* (for developing the electrostatic latent image on the photosensitive drum 32*a* with toner). In detail, the development density of the electrostatic latent image on the photosensitive drum 32*a* is adjusted so that high-quality toner images from a solid image to a fine-line image, can be formed.

Figure 10:
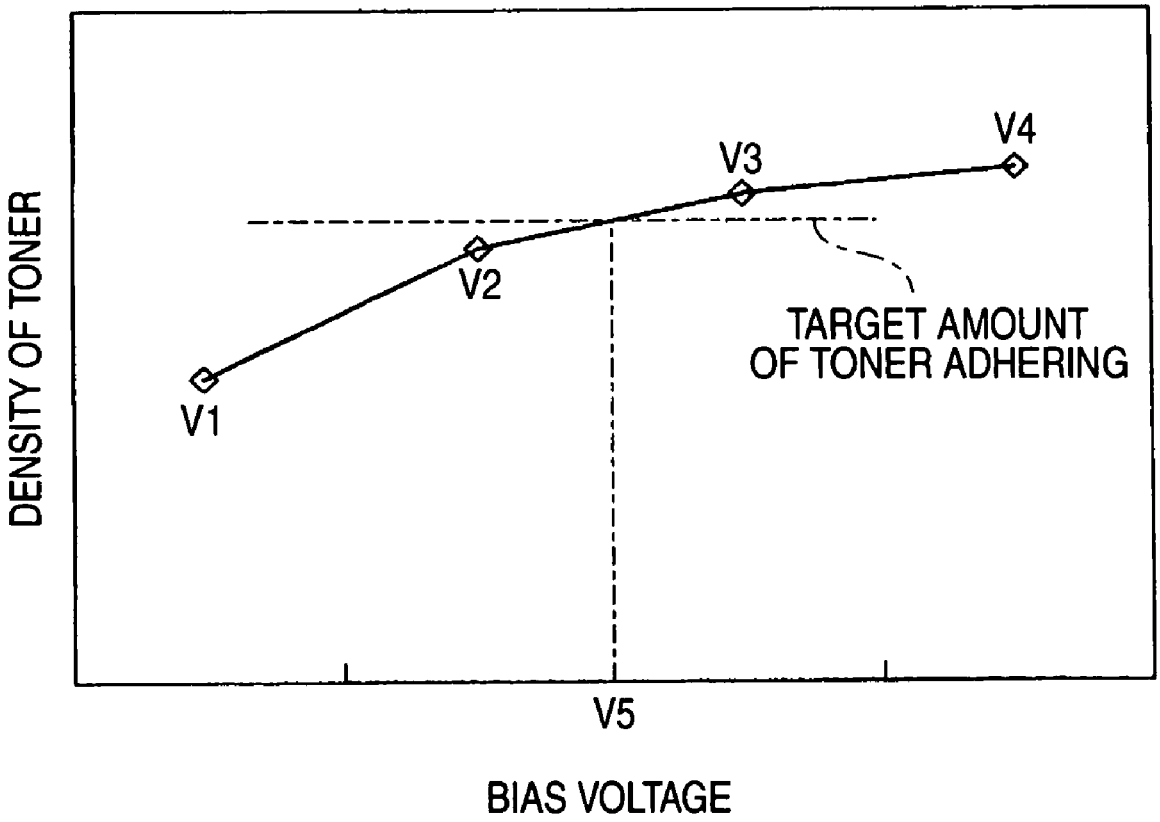
FIG. 10 is a graph for illustrating adjustment of a bias voltage on the basis of a result of detection performed by a patch sensor.

Specifically, the CPU 13 forms an electrostatic latent image used for forming a patch image for test purpose; e.g., a patch image such as a solid image or a fine-line image, within a small area in the axial center on the photosensitive drum 32*a*. After the patch image has been developed with toner by the development cartridge 37, the density of the patch image (toner image) transferred on the intermediate transfer belt 34 is detected by use of the patch sensor 69. On the basis of a result of detection, the CPU 13 adjusts the bias voltage applied between the photosensitive drum 32*a* and the development roller 42. At this time, as shown in FIG. 10, the CPU 13 changes the bias voltage used for developing the patch image with toner to any of voltages V1 to V4. After the density of the patch image has been detected at respective voltages, a bias voltage V5, at which the target density of toner (the target amount of toner adhering) can be achieved, is computed from the detection result by means of interpolation (a complementary method), thereby optimizing a bias voltage used for developing the electrostatic latent image on the photosensitive drum 32*a* with toner. The bias voltage V5 obtained through patch processing may be written in the nonvolatile memory 66 for each development cartridge 37 and utilized for replacement.

The toner on the outer peripheral surface 42*a* of the development roller 42 is made uniform over the entire axial length of the development roller 42 by means of the tip end edge 47*a* of the control blade 47 at least without becoming thinner in the axial opposite ends of the outer peripheral surface 42*a* than in the vicinity of the center of the same. The toner density of the patch image developed with the toner located in the vicinity of the center is detected by the patch sensor 69, and the bias voltage used for causing the toner to transfer from the development roller 42 to the photosensitive drum 32*a* is adjusted. Consequently, the density of the toner image can be adjusted with reference to the patch image that has been developed at least so as not to become thicker than other locations. Thus, occurrence of an erroneous adjustment for making a toner image partially thin can be avoided. In addition to making the thickness of the toner on the outer peripheral surface 42*a* of the development roller 42 high-quality, uniform in the axial direction thereof, the development density of the electrostatic latent image on the photosensitive drum 32*a* can be optimized, thereby forming a high-quality image.

As mentioned above, in the present embodiment, the toner on the outer peripheral surface 42*a* of the development roller 42 curved in an escaping direction can be scraped and left by the tip end edge 47*a* of the control blade 47, to thus make the thickness of toner entering between the tip end edge 47*a* and the outer peripheral surface 42*a* uniform in the axial direction, by means of a simple structure for relatively reducing the extent to which the tip end edge 47*a* of the control blade 47 protrudes in the tangential direction of the outer peripheral surface 42*a* of the development roller 42, by merely causing the center portion of the tip end edge 47*a* to recede from opposite ends thereof. Further, the center of the control blade 47 is curved in the direction where the control blade 47 is brought into compressed contact with the development roller 42, so that the gap between the outer peripheral surface 42*a* of the development roller and the tip end edge 47*a* can be made uniform in the axial direction. Together with the working-effect occurred by the center portion of the tip end edge 47*a* of the control blade 47 being caused to recede, the axial thickness of the toner on the outer peripheral surface 42*a* of the development roller can be made more uniform with higher accuracy. Therefore, the electrostatic latent image on the surface of the photosensitive drum 32*a* can be developed with high quality with toner, and the high-quality image can be formed.

The above-described embodiment has described a case where the extent to which the tip end edge 47*a* of the control blade 47 is adjusted such that the thickness of the toner on the outer peripheral surface 42*a* of the development roller 42 becomes axially uniform. However, the gap between the photosensitive drum 32*a* and the development roller 42 also becomes nonuniform because of deflection of the development roller 42. There may arise a case where the nonuniformity of the gap affects transfer of the toner from the outer peripheral surface 42*a* of the development roller 42 to the photosensitive drum 32*a*; i.e., a so-called amount of transfer (the amount of splash), which in turn induce a problem in the development quality of the electrostatic latent image on the photosensitive drum 32*a*. In another mode of the present embodiment, in such a case, the extent to which the tip end edge 47*a* of the control blade 47 projects can also be adjusted such that the amount of transfer becomes uniform in the axial direction.

The tip end edge 47*a* of the control blade 47 is set at a position on the outer peripheral surface 42*a* of the development roller 42 whose axial thickness of the toner is made more uniform, such that the thickness of the toner becomes smaller. The patch sensor 69 is placed at a position corresponding to the vicinity of the center portion of the outer peripheral surface 42*a* where the thickness of the toner is adjusted to become thinnest, thereby optimizing the density of the toner image formed by developing the electrostatic latent image on the photosensitive drum 32*a* (the bias voltage). Hence, occurrence of an erroneous adjustment for making a toner image thin can be avoided. In addition to making the thickness of the toner on the outer peripheral surface 42*a* uniform with respect to the axial direction thereof, the development density of the electrostatic latent image on the photosensitive drum 32*a* can be optimized, thereby forming a high-quality image.

The above-described embodiment has described a case where the patch sensor 69 is placed at one location corresponding to the vicinity of the axial center on the outer peripheral surface 42*a* of the development roller 42, where the toner does not become thick as compared with other locations. However, in another mode of the present embodiment, when an extent to which tip end edge of the control blade is set such that the toner on opposite ends of the development roller do not become thicker than that on other portions of the same, the patch sensor is placed at two positions corresponding to the two ends. Moreover, the above-described embodiment has mentioned a case where the photosensitive drum 32*a* and the development roller 42 oppose each other in a non-contacting manner. However, the present invention may also be applied to an image forming apparatus adopting an electrophotographic system, wherein a development roller comes into compressed contact with a photosensitive drum to thus cause toner to adhere to an outer peripheral surface of the photosensitive drum, thereby developing the electrostatic latent image on the photosensitive drum.

Although an embodiment of the present invention has been described thus far, it goes without saying that the present invention is not limited to the above-described embodiment and can be carried out in various forms within the technical scope of the invention. For instance, the above-described embodiment illustrates, as an example, an apparatus capable of housing a plurality of development cartridges within a development rotary unit. However, the present embodiment is not limited to such an apparatus. The present invention can also be appropriately applied to an image forming apparatus of a type which enables removable attachment of a single development cartridge. Further, the present embodiment has described, as an example, the case where a toner image on a photosensitive drum is transferred to a recording sheet via an intermediate transfer belt. However, the present invention is not limited to such a case. Needless to say, the present invention can also be appropriately applied to an image forming apparatus of a type which directly transfer an image from a photosensitive member to a recording sheet.

What is claimed is:

1. An image forming apparatus comprising:

an image carrier on which an electrostatic latent image is formed;

a developer, comprising:

a container, containing toner;

a first roller, facing the image carrier, and rotated to cause the toner to adhere onto the image carrier to develop the electrostatic latent image as a toner image;

a second roller, supplying the toner from the container to the first roller; and a control member, extending in an axial direction of the first roller, and brought into contact with the first roller, wherein a tip end edge of the control member is situated in an upstream side of a contact line that extends in the axial direction so as to include at least one contact point between the control member and the first roller, relative to a rotating direction of the first roller, a distance between the tip end edge and the contact line is not constant relative to the axial direction, and a distance between opposite end portions of the tip end edge in the rotating direction and the contact line is greater than a distance between a center portion between the opposite end portions and the contact line so that the tip end edge has an arcuate shape.

2. The image forming apparatus according to claim 1, wherein a gap defined between the tip end edge and a peripheral surface of the first roller is made constant in the axial direction.

3. The image forming apparatus according to claim 1, wherein the contact line is adapted to be more strongly brought in contact with a center portion of the first roller in the axial direction than opposite end portions of the center portion in the rotating direction.

4. The image forming apparatus according to claim 1, further comprising a patch sensor, detecting density information of the toner image; and a controller, adjusting density of the toner to be adhered onto the image carrier in association with the density information, wherein the patch sensor is arranged at a position corresponding to a position in a peripheral surface of the first roller at which less toner tends to be adhered.

5. The image forming apparatus according to claim 4, wherein a distance between opposite end portions of the tip end edge in the rotating direction and the contact line is greater than a distance between a center portion between the opposite end portions and the contact line, and the patch sensor is arranged so as to detect the toner information of the toner image that is developed with the toner corresponding to the center portion.

6. The image forming apparatus according to claim 4, wherein a contact pressure of the control member is not constant relative to the axial direction of the first roller.

7. The image forming apparatus according to claim 6, wherein the patch sensor is arranged so as to detect the toner information of the toner image that is developed with the toner having been held at a position in the peripheral surface of the first roller at which the contact pressure is most strongly applied.

* * * * *